US007264455B2

(12) United States Patent
Lipscombe

(10) Patent No.: US 7,264,455 B2
(45) Date of Patent: Sep. 4, 2007

(54) ROTARY POSITIVE DISPLACEMENT HYDRAULIC MACHINES

(76) Inventor: Brian Robert Lipscombe, 47 Oakfield Road, Bishops Cleeve, Cheltenham, Gloucestershire (GB) Gl52 8LA ( * ) Notice: Subject to any disclaimer, the term of this patent is extended or adjusted under 35 U.S.C. 154(b) by 359 days.

(21) Appl. No.: 10/986,836

(22) Filed: Nov. 15, 2004

(65) Prior Publication Data

US 2005/0106055 A1 May 19, 2005

(30) Foreign Application Priority Data

Nov. 15, 2003 (GB) ..... 0326655.8

(51) Int. Cl.
*F01C 19/08* (2006.01)
*F03C 2/00* (2006.01)
*F04C 2/00* (2006.01)

(52) U.S. Cl. ..... 418/131; 418/132; 418/206.1; 418/206.6

(58) Field of Classification Search ..... 418/75, 418/131–133, 206.1, 206.6, 206.7, 206.8
See application file for complete search history.

(56) References Cited

U.S. PATENT DOCUMENTS 3,280,754 A * 10/1966 Marietta ..... 418/131
4,281,974 A * 8/1981 Teruyama ..... 418/132
5,273,411 A * 12/1993 Lipscombe ..... 418/132

FOREIGN PATENT DOCUMENTS

| | | | | |
|---|---|---|---|---|
| GB | 266249 | | 2/1927 | |
| GB | 1008726 | | 11/1965 | |
| GB | 2233712 A | * | 1/1991 | ..... 418/132 |
| GB | 2 247 923 | | 3/1992 | |
| JP | 11002190 A | * | 1/1999 | |

* cited by examiner

*Primary Examiner*—Theresa Trieu
(74) *Attorney, Agent, or Firm*—Young & Thompson

(57) ABSTRACT

A rotary positive displacement hydraulic machine includes a housing defining two mutually intersecting parallel working chambers having a low pressure inlet side and a high pressure outlet side. Two meshing rotors are mounted for rotation in the two chambers, respectively. Bearing supports at opposite ends of the chambers, support bearings in which the rotors are journalled for rotation. At least one end of the housing is closed by an end cover. The end cover and adjacent housing end have at least one elongate recess on each side of the working chambers. The end cover recesses are alignable with the housing recesses. There is at least one keying element in each pair of aligned recesses so that the open end of the housing is supported against relative movement by differential fluid pressure in the chambers in a direction transverse to a plane containing the axes of rotation of the meshing rotors.

13 Claims, 8 Drawing Sheets

ROTARY POSITIVE DISPLACEMENT HYDRAULIC MACHINES

INTRODUCTION

This invention relates to rotary positive displacement hydraulic machines in the form of gear pumps and motors.

Rotary positive displacement machines, in the form of gear pumps and motors, generally comprise a housing having two mutually intersecting parallel working chambers, two meshing rotors mounted for rotation in the two chambers, respectively, and two bearing supports at opposite ends of the chambers and each supporting bearings in which the two rotors are journalled for rotation.

A common design is for the housing to have only one open end which is closed by a separate end cover having an integral bearing support. These are known as "pot-bodied" machines. It is, however, also known to provide the housing with two open ends each of which is closed by a separate end cover. Some such designs have the bearing supports integral with the end covers. Others have the bearing supports in the open ended housing. The end covers which are not integral with the housing are secured to the housing by bolts which extend through the housing and end cover(s).

When, for example, these known machines are used as pumps, hydraulic fluid is drawn into the chambers through a low pressure inlet port and is delivered to a high pressure outlet port by rotating pockets between the rotors and the housing. The operating pressure on the delivery side of the pump is very high, often as high as 300 bar, and it follows that the pressure differential between the inlet or suction side of the pump and the outlet or delivery side of the pump is also very high.

In order to ensure good volumetric efficiency, it is important that liquid clearance losses between the low and high pressure sides of the pump are kept to a minimum. It is also important to maintain proper alignment of the bearings as otherwise the performance and durability of the bearings will decrease. The high pressure on the outlet or delivery side of the pump causes the housing to deflect and can also cause one or both bearing supports to move relative to the housing. This increases the radial clearance losses thus reducing the volumetric efficiency of the machine. It can also cause the bearings to move out of alignment, particularly in "pot-bodied" machines where the deflection occurs at one end only.

It is known from GB-A-2247923 to provide the or each open end of the housing with a non-circular inner rim which is received within a recess of matching non-circular shape defined by a flange projecting from a peripheral region of a respective end cover in a direction parallel to the axes of rotation of the meshing rotors. The or each open end of the housing is thus supported by its end cover against outward deflection under the effect of fluid pressure in the chambers in a plane transverse to the axes of rotation of the meshing rotors.

The non-circular inner rim and matching non-circular recess are difficult to machine accurately and require complex CNC programming. Also, although this arrangement provides good alignment and support in a direction normal to the aforesaid plane (i.e. in the direction of the minor axis), no support is given in the direction of the major axis. Under the influence of internal pressure the major sides of the housing deflect outwards to a small extent whilst the minor sides of the housing contract away from the mating edges of the peripheral flange on the end cover. The flange thus only limits body deflection in an outwards direction. Furthermore, there has to be an axial clearance between the peripheral flange and the end face of the housing in order to ensure that the end face of the inner rim seats against the base of the recess. The end cover is secured to the housing by bolts and this axial clearance results in a bolt load overhang which imposes a considerable bending load on the flange profile.

SUMMARY OF THE INVENTION

In seeking to overcome these drawbacks, the present invention provides a rotary positive displacement hydraulic machine in the form of a gear pump or motor comprising a housing defining two mutually intersecting parallel working chambers having a low pressure inlet side and a high pressure outlet side, two meshing rotors mounted for rotation in the two chambers, respectively, and two bearing supports at opposite ends of the chambers and each supporting bearings in which the two rotors are journalled for rotation, wherein at least one end of the housing is closed by a separate end cover and wherein the or each separate end cover and an adjacent end of the housing each has at least one elongate recess on each of the two major sides of the working chambers, the recesses in the or each end cover being alignable with respective recesses in the adjacent end of the housing and there being at least one elongate keying element in each pair of aligned recesses so that the or each open end of the housing is supported against outward deflection by differential fluid pressure in the chambers in a direction transverse to a plane containing the axes of rotation of the meshing rotors.

The invention will now be more particularly described, by way of example, with reference to the accompanying drawings.

DESCRIPTION OF THE PREFERRED EMBODIMENTS

Figure 1:
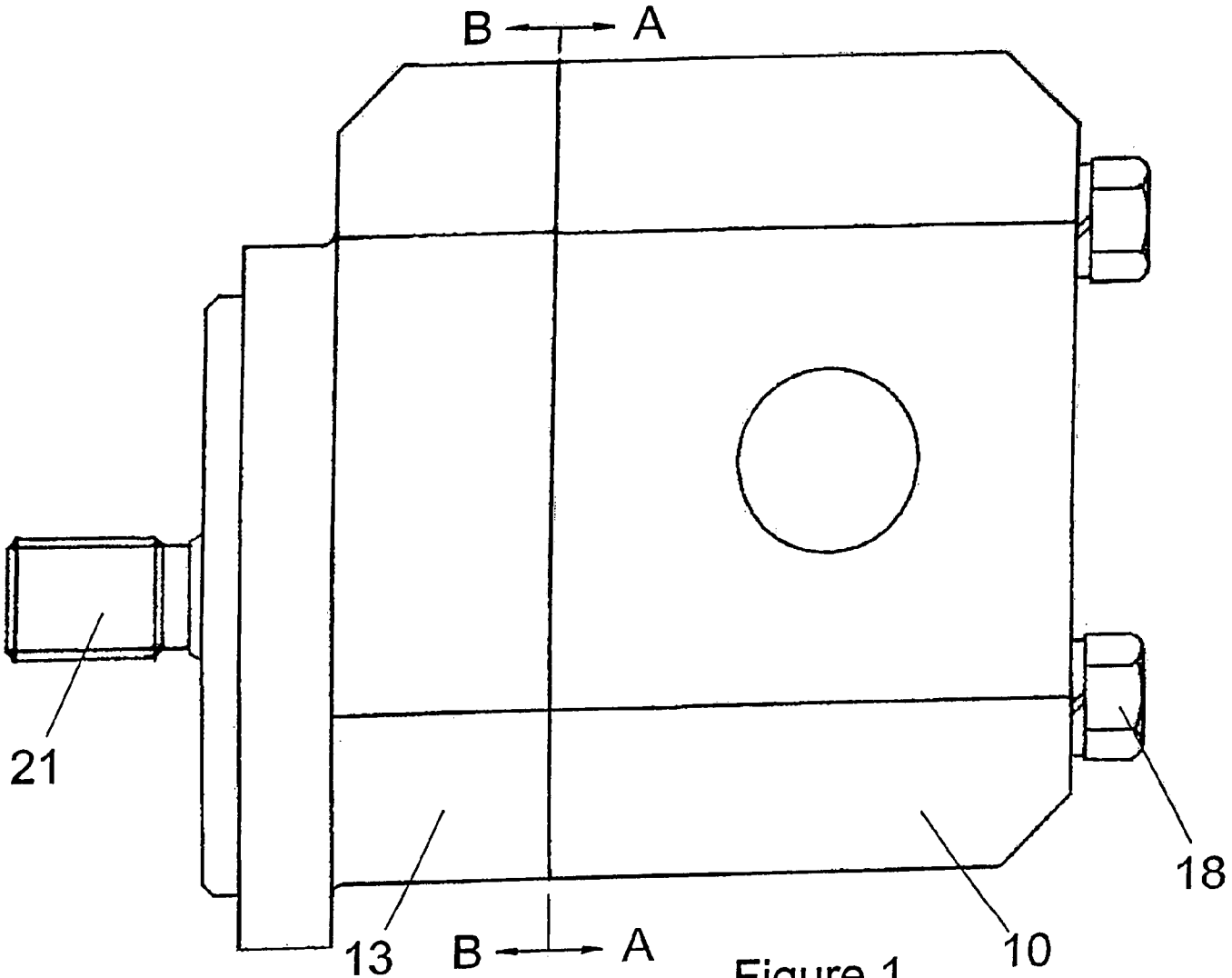
FIG. 1 is a side view of one embodiment of a rotary positive displacement hydraulic machine according to the present invention.
Figure 2:
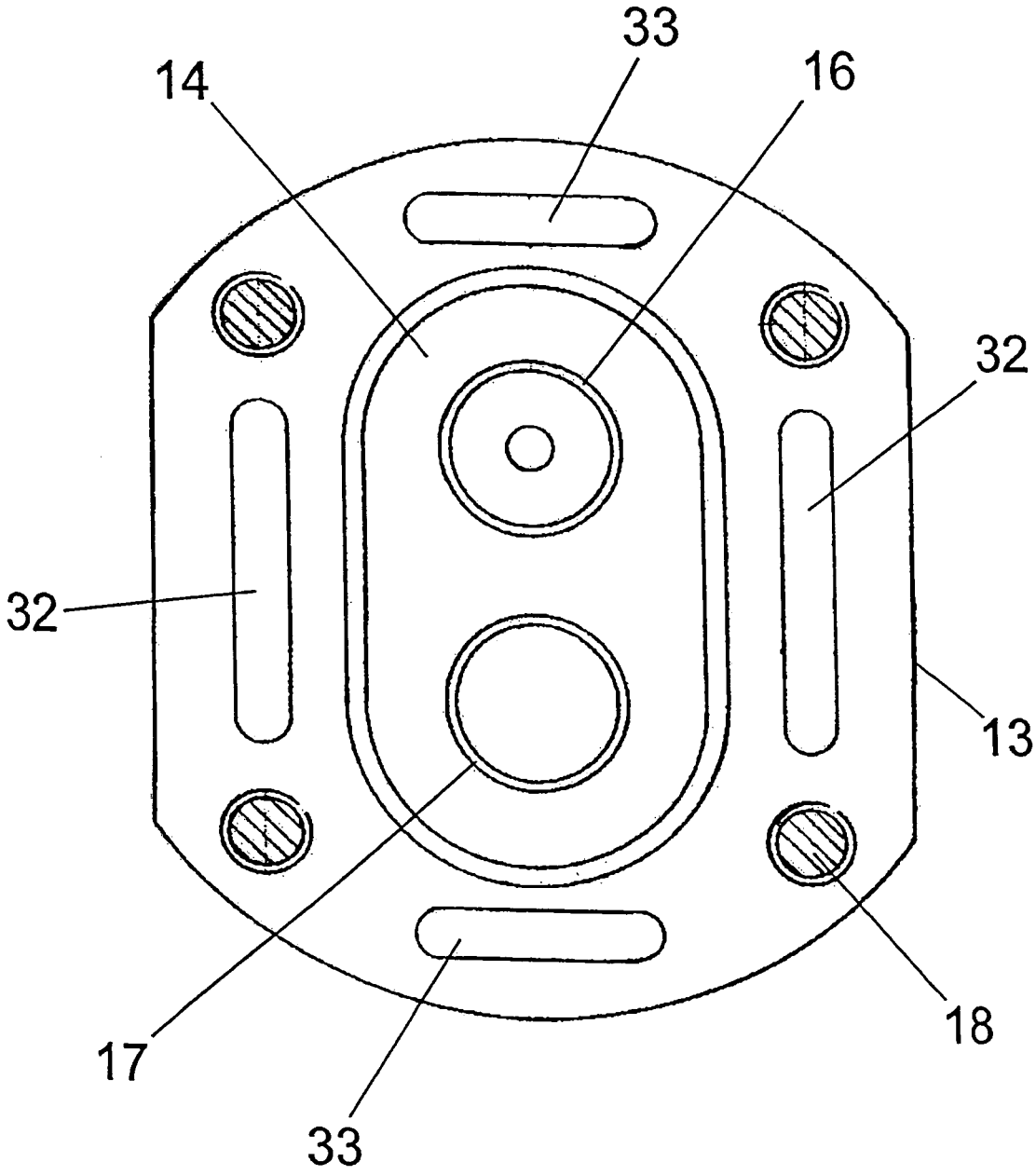
FIG. 2 is a section taken along line B-B of FIG. 1.

Referring firstly to FIGS. 1 to 6 of the drawings, the positive displacement hydraulic machine shown therein is in the form of a gear pump, although it could be in the form of a motor. The pump has a pump body comprising a housing 10 which defines two mutually intersecting parallel working chambers 11 and 12. The housing is "pot-bodied" and closed at one end. The other open end of the housing 10 is closed by an end cover 13.

The closed end of the housing 10 and the end cover 13 have integral one piece bearing supports 14 and 15, respectively, each of which supports two sleeve bearings 16 and 17. The end cover 13 is clamped to the housing 10 by bolts 18.

Two meshing pump rotors in the form of gears 19 and 20 are mounted for rotation in the chambers 11 and 12, respectively. The gear 19 is integral with a drive shaft 21 which is supported in the sleeve bearings 16 in the two bearing supports 14 and 15 and which passes through an aperture 22 in the end cover 13 so that it can be connected to a power source. The gear 20 is integral with a driven shaft 23 which is supported in the sleeve bearings 17 in the two bearing supports 14 and 15 and which is contained entirely within the pump body.

The pump body has a low pressure inlet port 24 and a high pressure outlet port 25, each of which communicates with both chambers 11 and 12.

The pump also includes two pressure balancing plates 26 and 27 interposed between the end faces of the two meshing gears 19 and 20 and respective bearing supports 14 and 15, with a small degree of axial freedom.

Figure 3:
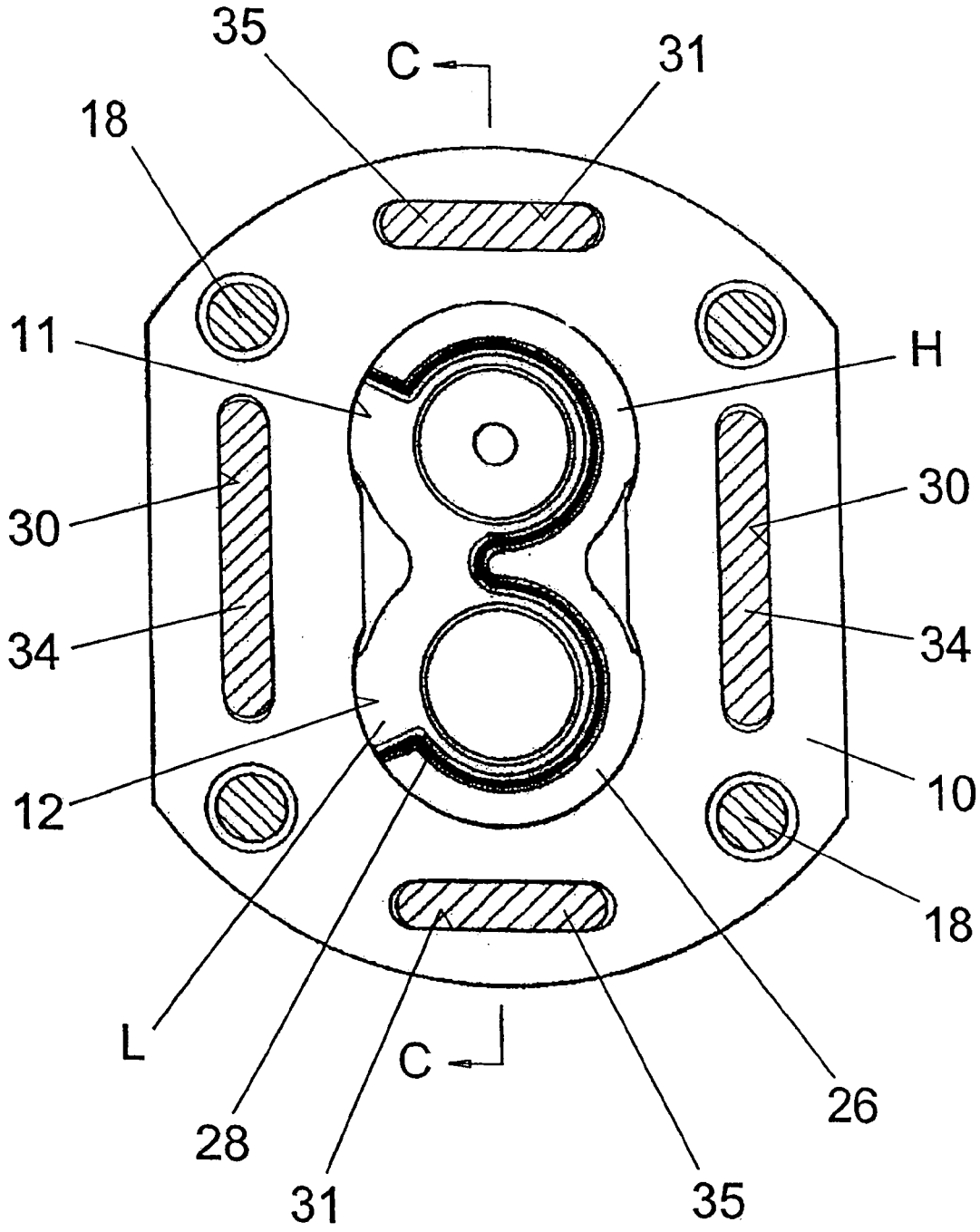
FIG. 3 is a section taken along line A-A of FIG. 1.

The pressure balancing plates 26 and 27 are typically of leaded bronze, and the face F of each plate 26, 27 remote from the meshing gears is provided with seals 28 mounted in a groove in the plate, although the seals 28 could be mounted in a groove in the end face of the adjacent bearing support. Each plate 26, 27 is of figure of eight shape and each seal 28 is roughly in the shape of a figure three, but at each end has a tail which extends radially outwards to the outer edge of a respective plate 26, 27. Other seal configurations could be utilised including those which provide for bidirectional operation of the pump. As best shown in FIG. 3, the seals divide the face F of each plate into two areas, one of which is a high pressure area H and is in communication with the port 25 and the other of which is a low pressure area L and is in communication with the port 24.

The high and low pressure areas are designed to coincide with the high and low pressure sides of the pump so that when the pump is in operation liquid pressure acting upon the two areas L and H of the face F act in opposition to the pressure applied to the opposite face of each plate 26, 27 by the liquid being carried through the pump by the gears 19 and 20, and ensure that the plates 26, 27 are urged into adequate sealing engagement with the end faces of the gears without the generation of undue friction between the plates and the end faces.

As mentioned previously, the operating pressure on the delivery side of the pump is very high, often as high as 300 bar, and this pressure will act on the housing 10 on the delivery side of the pump in such a way that, if unrestrained, the housing will deflect outwards at its open end, i.e. that end connected to the end cover 13. If this were to happen, it would result in increased radial clearance losses and a consequential reduction in volumetric efficiency of the pump. Also, the bearings of the pump will move out of alignment with the result that the performance and durability of the bearings will decrease.

In order to minimise this deflection, the open end of the housing 10 has a single elongate recess 30 along each of the two major sides of the working chambers 11 and 12 and a single further recess 31 at each of the two minor sides of the working chambers 11 and 12. As shown, the recesses 30 extend parallel to a plane containing the axes of rotation of the meshing rotors 19 and 20 and the further recesses 31 extend perpendicularly to the aforesaid plane. The recesses 30 and 31, as shown, extend rectilinearly and have rounded ends. The recesses 30 and 31 are centrally located in respective sides of the open end of the housing 10 and are located intermediate the inner and outer edges of the end face of the housing 10.

Figure 4:
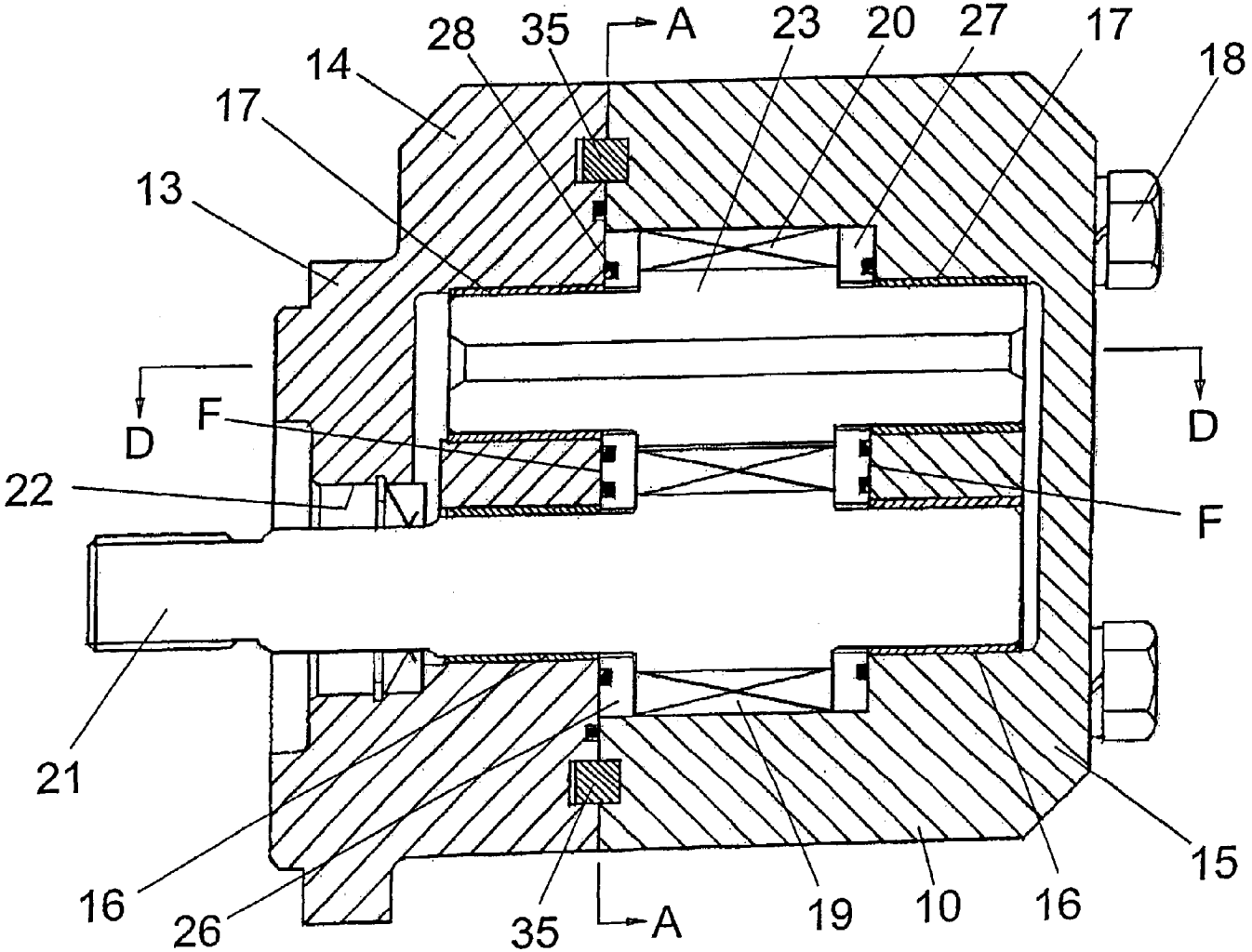
FIG. 4 is a section taken along line C-C of FIG. 3.
Figure 5:
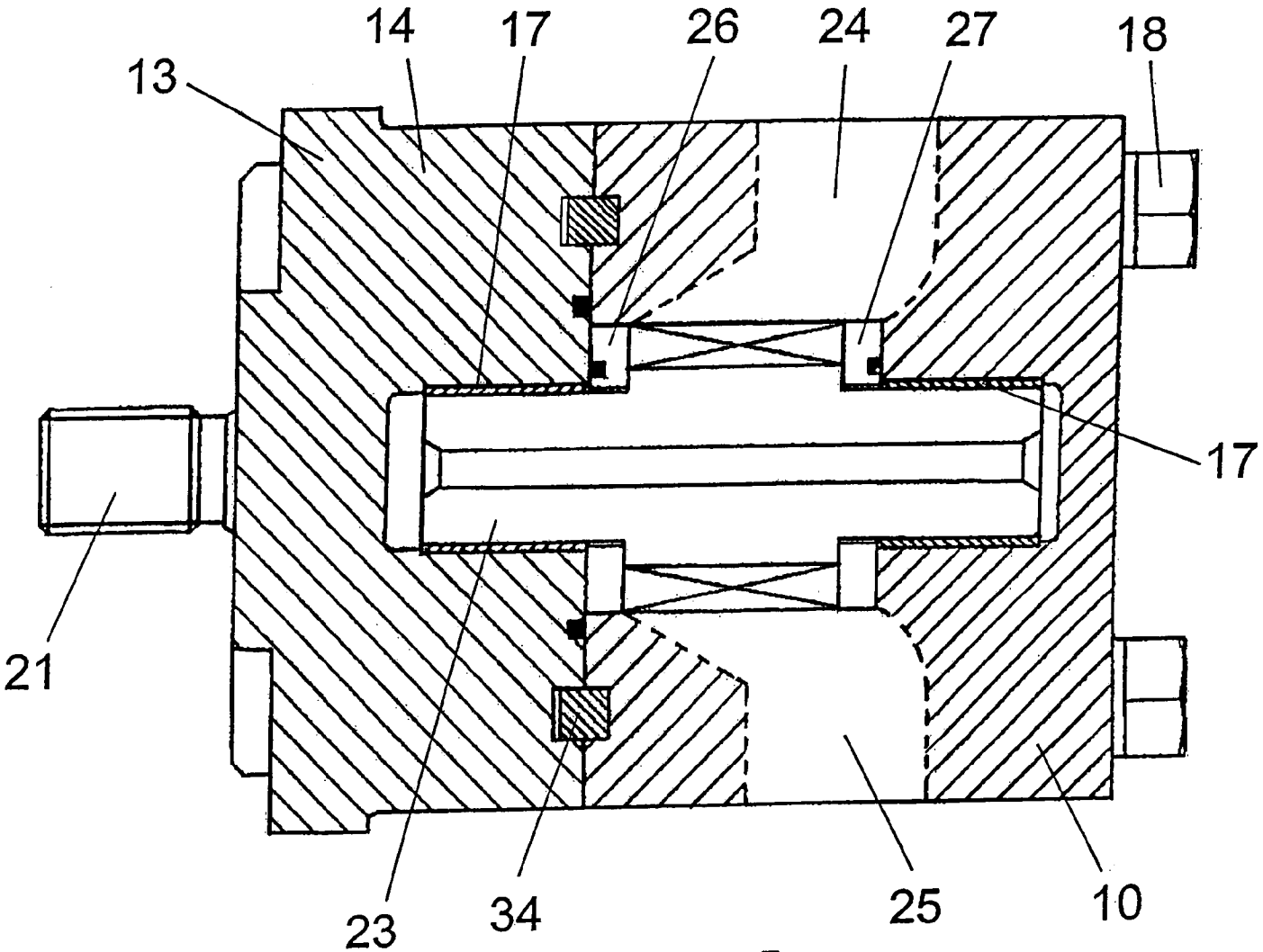
FIG. 5 is a section taken along line D-D of FIG. 4.
Figure 6:
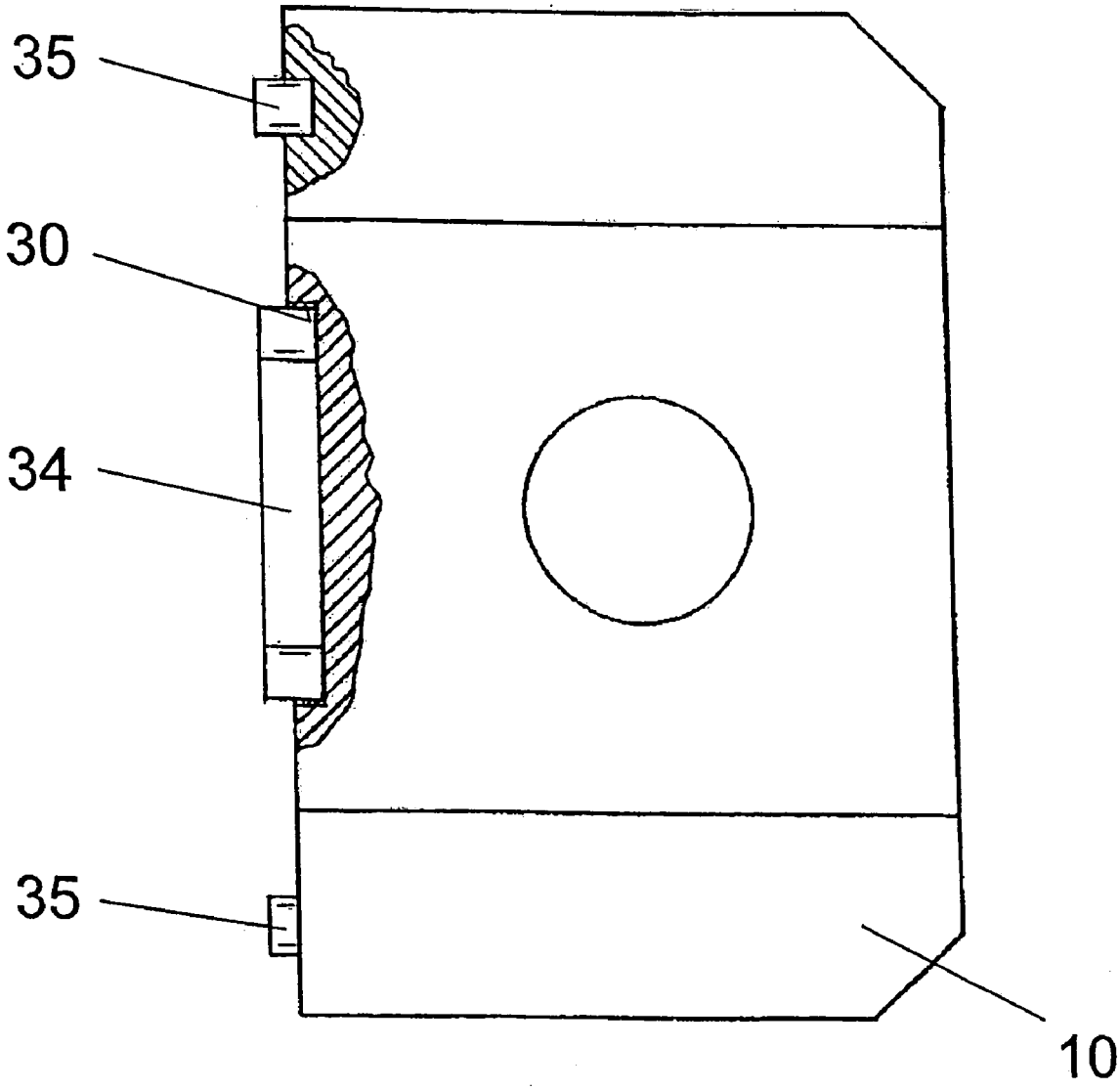
FIG. 6 is a cut away side view of the housing of the machine of FIGS. 1 to 5 showing the keying elements.

Corresponding recesses 32 and further recesses 33 are provided in the end face of the end cover 13 so that the recesses 30 in the end face of the housing 10 and the recesses 32 in the end face of the cover 13 can be aligned with one another and the further recesses 31 in the end face of the housing and the further recesses 33 in the end face of the cover 13 can be aligned with one another. Elongate keying elements 34, typically of steel, shown in FIGS. 3, 5 and 6 are inserted into the recesses 30 and project into the recesses 32. Further elongate keying elements 35 shown in FIGS. 3, 4 and 6 are inserted in the further recesses 31 and project into the further recesses 33.

The keying elements 34 and 35 are a transition fit in aligned pairs of recesses in a direction transverse to their longitudinal extent, but may be a loose fit in aligned pairs of recesses in the direction of their longitudinal extent. By "transition fit" we mean a fit where there is negligible clearance or negligible interference with the sides of the recesses in a direction transverse to the longitudinal extent of the keying elements.

The keying elements 34 interact between the housing 10 and end cover 13 so that the end cover 13 supports the housing 10 against outwards (and inwards) movement in a direction transverse to a plane containing the axes of rotation of the meshing rotors 19.

The keying elements 35 interact between the housing 10 and the end cover 13 to support the housing and end cover against movement in a direction parallel to the aforesaid plane.

The arrangement improves the stiffness of the pump body and improves body seal life by reducing fretting caused by relative displacement between the housing 10 and end cover 13.

The arrangement described above is a more efficient and cost effective way of minimising deflection of the housing than the solution proposed by GB-A-2247923. It gives consistent support to the open end of the body to minimise deflection and reduce stress levels improving fatigue life and performance. Initial alignment of the parts is controlled by simple accurately positioned recesses, together with the keying elements 34 and 35. The key fit in the recesses can be controlled by a difference in the key and recess widths and this may be advantageous for production reasons. In particular, the key widths can be varied to compensate for any machining errors saving costly scrap. The location accuracy of the recesses can be different in the minor axis X and major axis Y directions and is independent of one another. In other words the positional accuracy of the recesses 30 and 32 does not interfere with the positional accuracy of the recesses 31 and 33. The use of four keying elements prevents the body moving outwards on the minor axis and inwards on the major axis. They keying elements are commercially available at low cost and the manufacture of the recesses can use easily programmable common place machining technology. The arrangement could be applied retrospectively to most current gear unit designs to improve both performance and life without the need for major configuration changes.

The keying elements 34 and 35 as shown in the drawings are of square cross-section, but they could be of rectangular cross-section. Also, they do not need to have rounded ends as shown. There could be more than one keying element 34, 35 in each recess and there could be more than one recess 30, 32 along each major side of the housing and end cover, respectively, and indeed, there could be more than one further recess 31, 33 along each minor side of the housing and end cover. Also, the recesses and keying elements do not necessarily have to be rectilinear. There may be only one further recess 31 and one further recess 33. These need not be at the minor sides of the housing and end cover. The further recesses 31 and 33 could be omitted altogether or could, for example, be replaced by dowels. The advantage of elongate keying elements is, however, that they allow for tolerance errors in one direction.

Figure 7:
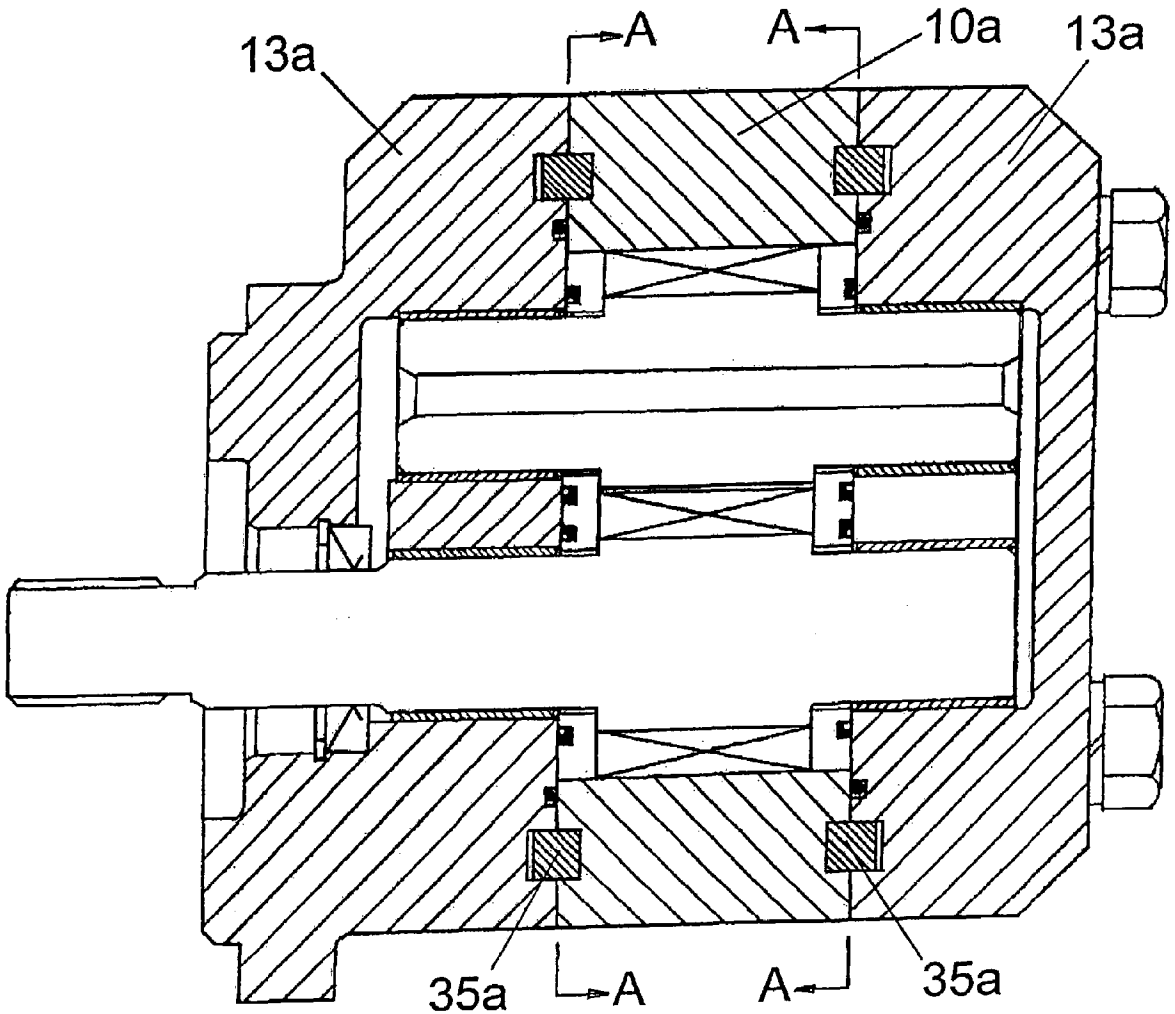
FIG. 7 is a section corresponding to FIG. 4 of another embodiment of a rotary positive displacement hydraulic machine according to the present invention.

FIG. 7 shows another embodiment of a rotary positive displacement hydraulic machine in which the housing 10*a* is open at both ends and is closed by two end covers 13*a*. In this case, both end covers 13*a* supports the housing 10 against outward deflection with the use of keying elements, of which only keying elements 35*a* are shown.

Figure 8:
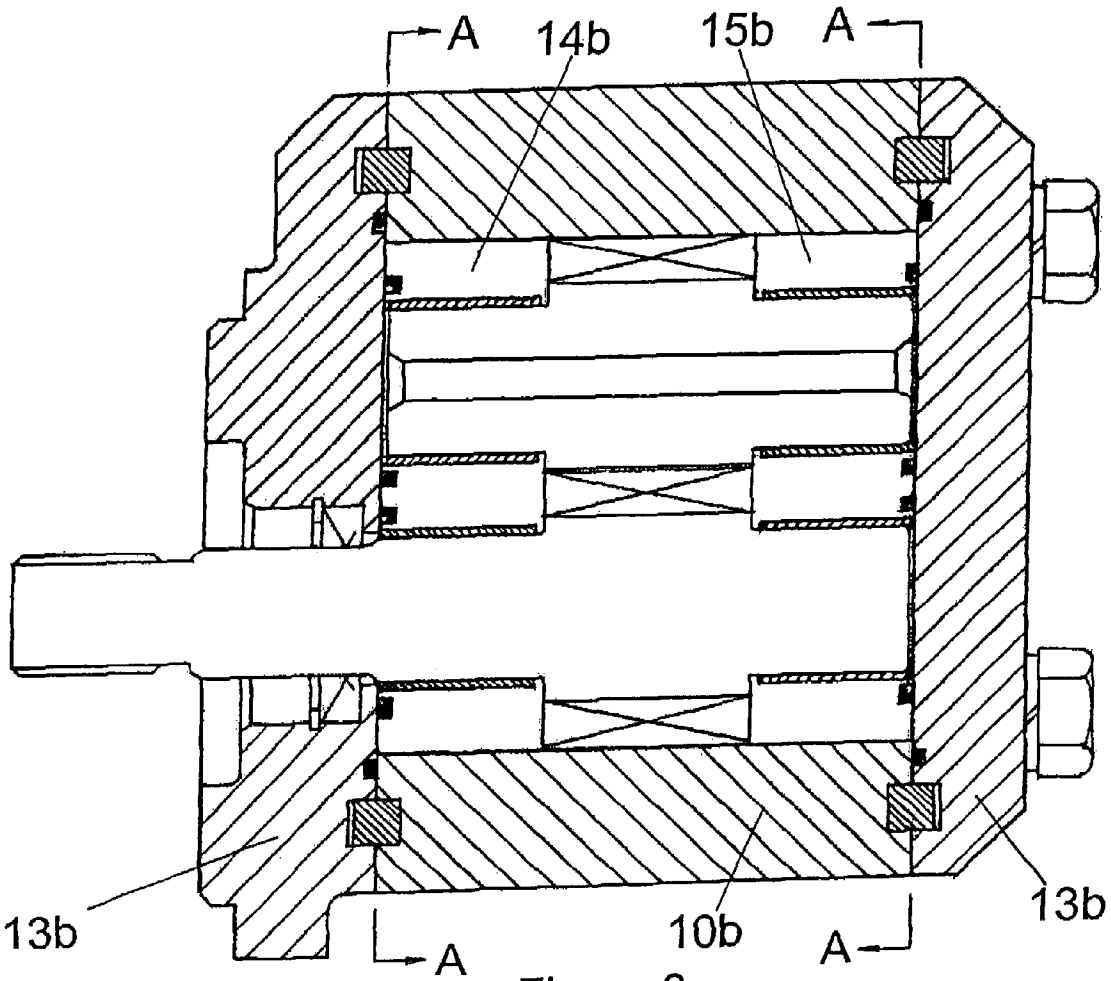
FIG. 8 is a section corresponding to FIG. 4 of yet a further embodiment of a rotary positive displacement hydraulic machine according to the present invention.

FIG. 8 shows yet a further embodiment of a rotary positive displacement hydraulic machine in which the bearing supports 14*b* and 15*b* are formed within the housing 10*b* and opposite ends of the housing 10*b* are closed by end covers 13*b* which, in this case, do not have integral bearing supports. Once again, the two ends of the housing are supported against outwards and inwards deflection by keying elements, of which only the keying elements 35*b* are shown.

The above embodiments are given by way of example only and various modifications will be apparent to persons skilled in the art without departing from the scope of the invention as defined by the appended claims. For example, the housing could define three or more working chambers and have a corresponding number of meshing rotors.

Also, it is conceivable that at least some of the keying elements could be formed as an integral part of an end cover and/or an adjacent end of the housing, such as by machining.

What is claimed is:

1. A rotary positive displacement hydraulic machine in the form of a gear pump or motor comprising a housing defining two mutually intersecting parallel working chambers having a low pressure inlet side and a high pressure outlet side, two meshing rotors mounted for rotation in the two chambers, respectively, and two bearing supports at opposite ends of the chambers and each supporting bearings in which the two rotors are journalled for rotation, wherein at least one end of the housing is closed by a separate end cover and wherein the or each separate end cover and an adjacent end of the housing each has at least one elongate recess on each of the two major sides of the working chambers, the recesses in the or each end cover being alignable with respective recesses in the adjacent end of the housing and there being at least one elongate keying element in each pair of aligned recesses so that the or each open end of the housing is supported against outward deflection by differential fluid pressure in the chambers in a direction transverse to a plane containing the axes of rotation of the meshing rotors.

2. A rotary positive displacement hydraulic machine as claimed in claim 1, wherein the recesses are parallel or substantially parallel to the plane containing the axes of rotation of the meshing rotors.

3. A rotary positive displacement hydraulic machine as claimed in claim 1, wherein the or each separate end cover and an adjacent end of the housing have at least one further elongate recess extending transversely to the first mentioned recesses.

4. A rotary positive displacement hydraulic machine as claimed in claim 3, wherein the or each separate end cover and an adjacent end of the housing have at least one said further elongate recess at each of the two minor sides of the working chambers.

5. A rotary positive displacement hydraulic machine as claimed in claim 3, wherein the said further recesses are perpendicular or substantially perpendicular to the plane containing the axes of rotation of the meshing rotors.

6. A rotary positive displacement hydraulic machine as claimed in claim 1, wherein the keying elements are a transition fit in aligned pairs of recesses in a direction transverse to their longitudinal extent.

7. A rotary positive displacement hydraulic machine as claimed in claim 1, wherein the keying elements are a loose fit in aligned pairs of recesses in the direction of their longitudinal extent.

8. A rotary positive displacement hydraulic machine as claimed in claim 1, wherein one end of the housing is closed by an integral end cover.

9. A rotary positive displacement hydraulic machine as claimed in claim 8, wherein the bearing support at the said one end of the housing is integral with the said integral end cover.

10. A rotary positive displacement hydraulic machine as claimed in claim 1, wherein the bearing support at the or each open end of the housing is integral with its respective end cover.

11. A rotary positive displacement hydraulic machine as claimed in claim 1, wherein the bearing support at the or each open end of the housing is not integral with its respective end cover.

12. A rotary positive displacement hydraulic machine in the form of a gear pump or motor comprising a housing defining two mutually intersecting parallel working chambers having a low pressure inlet side and a high pressure outlet side, two meshing rotors mounted for rotation in the two chambers, respectively, and two bearing supports at opposite ends of the chambers and each supporting bearings in which the two rotors are journalled for rotation, wherein at least one end of the housing is closed by a separate end cover and wherein the or at least one end cover and/or an adjacent end of the housing have between them at least two elongate recesses which recesses are on opposite major sides of the working chambers and integral elongate keying elements are provided on the other of the at least one end cover and/or the adjacent end of the housing for fitting in the elongate recesses so that the or each open end of the housing is supported against outward deflection by differential fluid pressure in the chambers in a direction transverse to a plane containing the axes of rotation of the meshing rotors.

13. A rotary positive displacement hydraulic machine as claimed in claim 12, wherein the or at least one end cover and/or an adjacent end of the housing has at least one further elongate recess which extends transversely to the first mentioned recesses and at least one integral elongate keying element is provided on the other of the at least one end cover or the adjacent end of the housing for fitting in the further elongate recess.

* * * * *